US006378997B1

(12) United States Patent
Nitta

(10) Patent No.: US 6,378,997 B1
(45) Date of Patent: Apr. 30, 2002

(54) MEDIA CARTRIDGE AND INK JET RECORDING APPARATUS

(75) Inventor: Tetsuhiro Nitta, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/637,358

(22) Filed: Aug. 15, 2000

(51) Int. Cl.[7] ..... B41J 2/175
(52) U.S. Cl. ..... 347/85; 347/86
(58) Field of Search ..... 347/84, 85, 86, 347/87

(56) References Cited

U.S. PATENT DOCUMENTS 4,556,894 A * 12/1985 Terasawa ..... 347/30
5,506,611 A 4/1996 Ujita et al. ..... 347/86

FOREIGN PATENT DOCUMENTS

JP 56-14992 2/1981
JP 59-190857 10/1984
JP 59190857 * 10/1984 ..... 347/86
JP 64-63186 3/1989
JP 3-67657 3/1991

* cited by examiner

*Primary Examiner*—Anh T. N. Vo
(74) *Attorney, Agent, or Firm*—Fitzpatrick, Cella, Harper & Scinto

(57) ABSTRACT

The invention provides a media cartridge detachably mounted on an ink jet recording apparatus having a carriage adapted to support an ink jet head for executing printing by discharging ink onto a recording medium and to execute a scanning motion and a conveying mechanism for conveying the recording medium, the cartridge comprising, in a same container, a cassette for stacking the recording medium, an ink tank for containing ink to be supplied to the ink jet head, and a waste ink tank for collecting the ink not used for recording by the ink jet head.

8 Claims, 6 Drawing Sheets

MEDIA CARTRIDGE AND INK JET RECORDING APPARATUS

BACKGROUND OF THE INVENTION

1. Field of the Invention

The present invention relates to a media cartridge integrally containing a combination of a recording medium and ink capable of obtaining a high-quality image on a recording medium in a package, and an ink jet recording apparatus capable of executing recording of high quality by recognizing the media cartridge.

2. Related Background Art

The ink jet recording method has advantages of low noise, low running cost, compactization of the apparatus, ability to form a color image etc. and is therefore widely utilized in printer and copying apparatus.

The ink jet recording apparatus based on such ink jet recording method can form various recording media, for example recording materials such as plain paper, coated paper, glossy paper, OHP (overhead projector) sheet, BPF (back print film), glossy film etc. or other materials such as cloth, leather or metal.

However, in order to obtain a high-quality image on various recording media, it is necessary to select an ink composition and a printing mode according to the recording medium.

For example, in case of plain paper, the water resistance of the image is not sufficient, and, if a color image is to be formed, the image of a high density not causing feathering cannot be easily made compatible with the image of satisfactory quality without blotting between the colors, so that the quality of the color image is inevitably deteriorated.

There is recently commercialized ink containing water resistant coloring material in order to improve the water resistance of the image. However, the water resistance is not only still unsatisfactory even in such ink, but such ink, being in principle difficultly soluble in water after drying, tends to cause clogging of the nozzle of the recording head, and there is required an improvement in the recording apparatus with inevitable complication of the structure thereof.

The Japanese Patent Application Laid-open No. 56-84992 discloses a method of coating the recording sheet, constituting the recording medium, in advance with a material for fixing the dye. In such method, however, it is necessary to use a specified recording sheet. Also the apparatus inevitably becomes bulky and expensive in order to coat in advance the material for fixing the dye, and it is also difficult to stably coat such fixing material on the recording sheet with a predetermined thickness.

Also the Japanese Patent Application Laid-open No. 64-63186 discloses a technology of depositing colorless ink (processing liquid) for insolubilizing the dye onto the recording sheet by means of the ink jet recording head. However, such discharging of the solution (processing liquid) for insolubilizing the dye by the ink jet recording head may result in deterioration of the image if the recording sheet already has an ink receiving layer coated on a base material such as an OHP sheet or coated paper.

On the other hand, deposition of a pigment on the OHP sheet or coated paper requires a long time for fixation, and the fixation for example with a heater leads to a larger and more complex structure of the apparatus with an inevitable increase in the cost.

For these reasons, in order to obtain a high-quality image on various recording media, it is necessary to select ink and print control mode for example on the printer driver according to the recording medium, and such selection is cumbersome for the operator and it may become impossible to obtain a desired image in case of an error in the operation.

On the other hand, the ink tank containing the ink is generally rendered replaceable on the recording apparatus, and is replaced by a new ink tank when the ink contained therein is used up. For this purpose, the apparatus is provided with a mechanism for detecting the remaining amount of the ink in the ink tank. However, such remaining ink amount detecting mechanism, being complicated in the structure, complicates the configuration of the recording apparatus. In order to resolve such situation, the Japanese Patent Application Laid-open No. 59-190857 proposes a cassette containing the recording sheets and the recording liquid, and discloses a configuration in which the amount of the recording liquid is maintained necessary minimum with respect to the number of the recording sheets, whereby the end of the ink is alternatively judged by the end of the recording sheets contained in the cassette whereupon the cassette is replaced by a new one.

However there has not been disclosed the combination of the recording medium and the ink or the setting of the printing mode, and there has not been considered the view of obtaining a high-quality recorded image, so that the aforementioned limitations on achieving high-quality recording have not been resolved.

Also the Japanese Patent Application Laid-open No. 3-67657 discloses a configuration of the ink and the recording apparatus, in which the information on the ink is indicated in pseudo manner by the resistance value of a resistor provided on the ink cassette, thereby allowing to set a recording mode or a recovery mode according to the ink. This patent application assumes the use of a specified recording medium and discloses the setting of the printing or recovery mode when different inks are supplied to such specified recording medium. Consequently there has not been disclosed the method of responding to different recording media.

SUMMARY OF THE INVENTION

In consideration of the foregoing, the object of the present invention is to provide a media cartridge and an ink jet recording apparatus capable of recording an image of high quality and high reliability, showing excellent water resistance by a simple operation and free from feathering or blotting between the colors in the color recording.

The present invention has been reached as a result of intensive investigations for attaining the above-mentioned object and is based on a finding that the satisfactory printing can be obtained by housing an appropriate combination of the recording media and the ink tank in a cartridge and transmitting the optimum printing mode to the recording apparatus.

The present invention, based on the above-mentioned finding, is to provide a media cartridge to be detachably arranged to an ink jet recording apparatus provided with a carriage driven in a scanning motion and be scanned and to mount an ink jet head for discharging ink for forming a recording on the recording medium, and a conveying mechanism for conveying the recording medium, the media cartridge comprising a cassette for stacking the recording media, an ink tank containing ink to be supplied to the ink jet head, and a waste ink tank for collecting the ink not used for recording by the ink jet head, in a single container.

According to the present invention, there is also provided a media cartridge to be detachably arranged to an ink jet recording apparatus provided with a carriage adapted to be scanned and to mount an ink jet head for discharging ink for forming a recording on the recording medium, and a conveying mechanism for conveying the recording medium, the media cartridge comprising a cassette for stacking the recording media, an ink tank containing ink to be supplied to the ink jet head, a waste ink tank for collecting the ink not used for recording by the ink jet head, and an information medium, in a single container.

The information medium may assume a configuration having information capable of setting a print mode on the recording apparatus, or a configuration to be rewritable with respect to the remaining ink amount in the ink tank.

It is preferred that the amount of the ink contained in the ink tank is necessary and sufficient for the number of the recording media stacked in the cassette.

Also the recording apparatus embodying the present invention comprises a mounting portion for mounting the media cartridge, a conveying mechanism for conveying the recording medium from the media cartridge, an ink supply portion connected to the ink tank of the media cartridge for supplying the ink jet head with ink, and a waste ink recovery portion for guiding the ink, not used for recording by the ink jet head, to the waste ink tank.

It is further preferred that the media cartridge is provided with the information medium while the recording apparatus is provided with a detecting portion linked with such information medium and adapted to transmit the information of the information medium to the recording apparatus.

Also the information medium is rendered rewritable with respect to the specified information, by the detecting portion.

The present invention is to allow secure selection of the ink and the print control method, optimum for the recording medium, thereby realizing high reliability for the image.

DESCRIPTION OF THE PREFERRED EMBODIMENTS

Now the present invention will be clarified in detail by preferred embodiments thereof, with reference to the accompanying drawings.

[First Embodiment]

Figure 1:
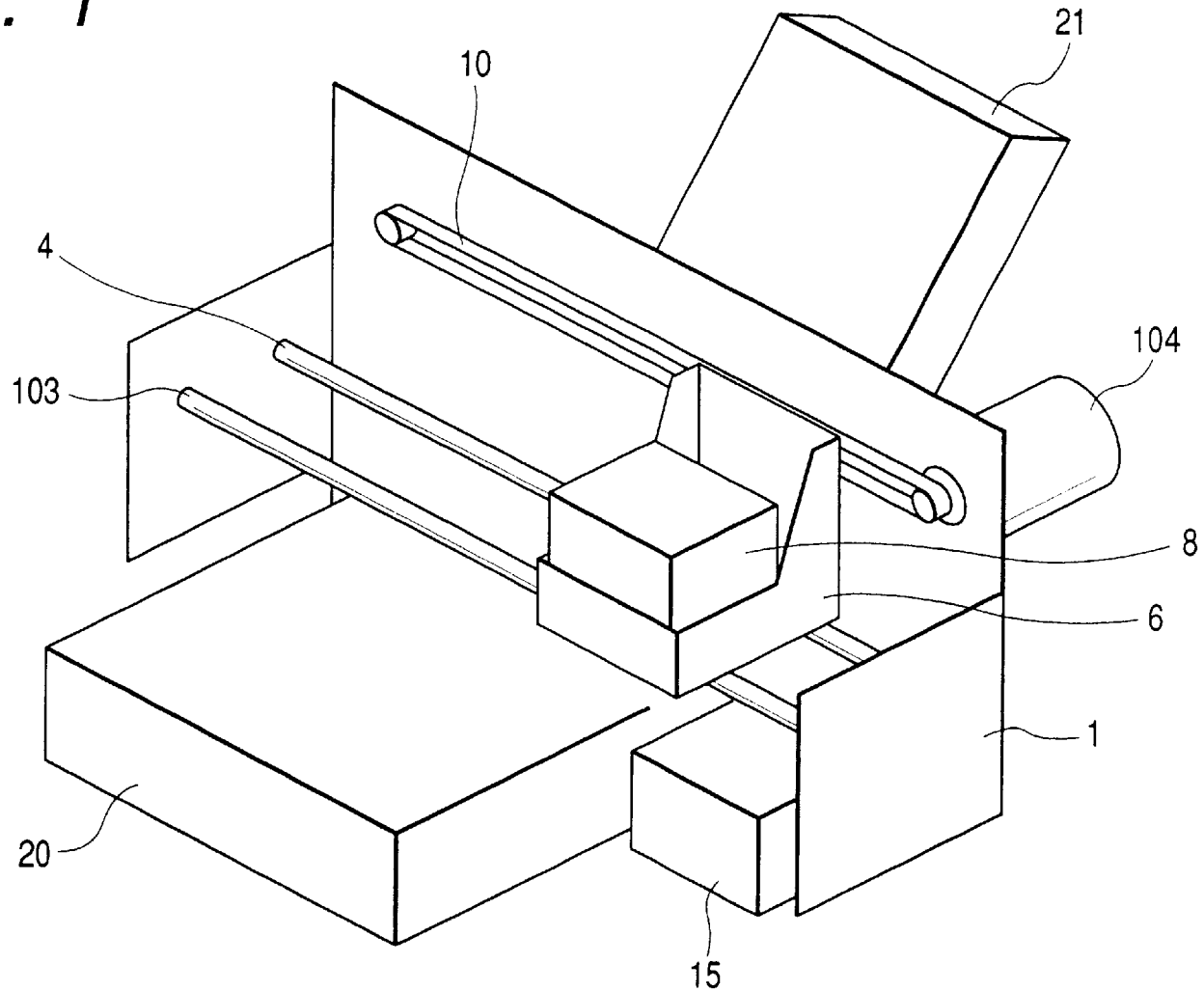
FIG. 1 is a schematic perspective view showing the configuration of a recording portion in a first embodiment.

FIG. 1 is a schematic perspective view showing the configuration of a recording portion. As shown in FIG. 1, a recording head 8 is mounted on a carriage 6.

On both side walls of an approximately square-C shaped chassis, there are mounted a guide shaft 4 and a support shaft 103 for slidably supporting the carriage 6. The carriage 6, executing a reciprocating motion on these shafts, is given a driving power from a carriage motor 104 through a driving belt 10.

In a home position at the right-hand side of the recording apparatus, there is provided a recovery unit 15. When the carriage 6 is at the home position, a suction cap is attached to and caps the recording head 8, in order to prevent the failure in discharge, caused by evaporation of the ink, leading to an increase in the viscosity or in solidification, in the nozzles of the recording head 8.

Also if the failure in discharge occurs in the recording head 8, such failure can be resolved by capping the recording head 8 with the suction cap and by activating a suction recovery mechanism for generating a negative pressure by a pump unit (not shown).

Figure 2:
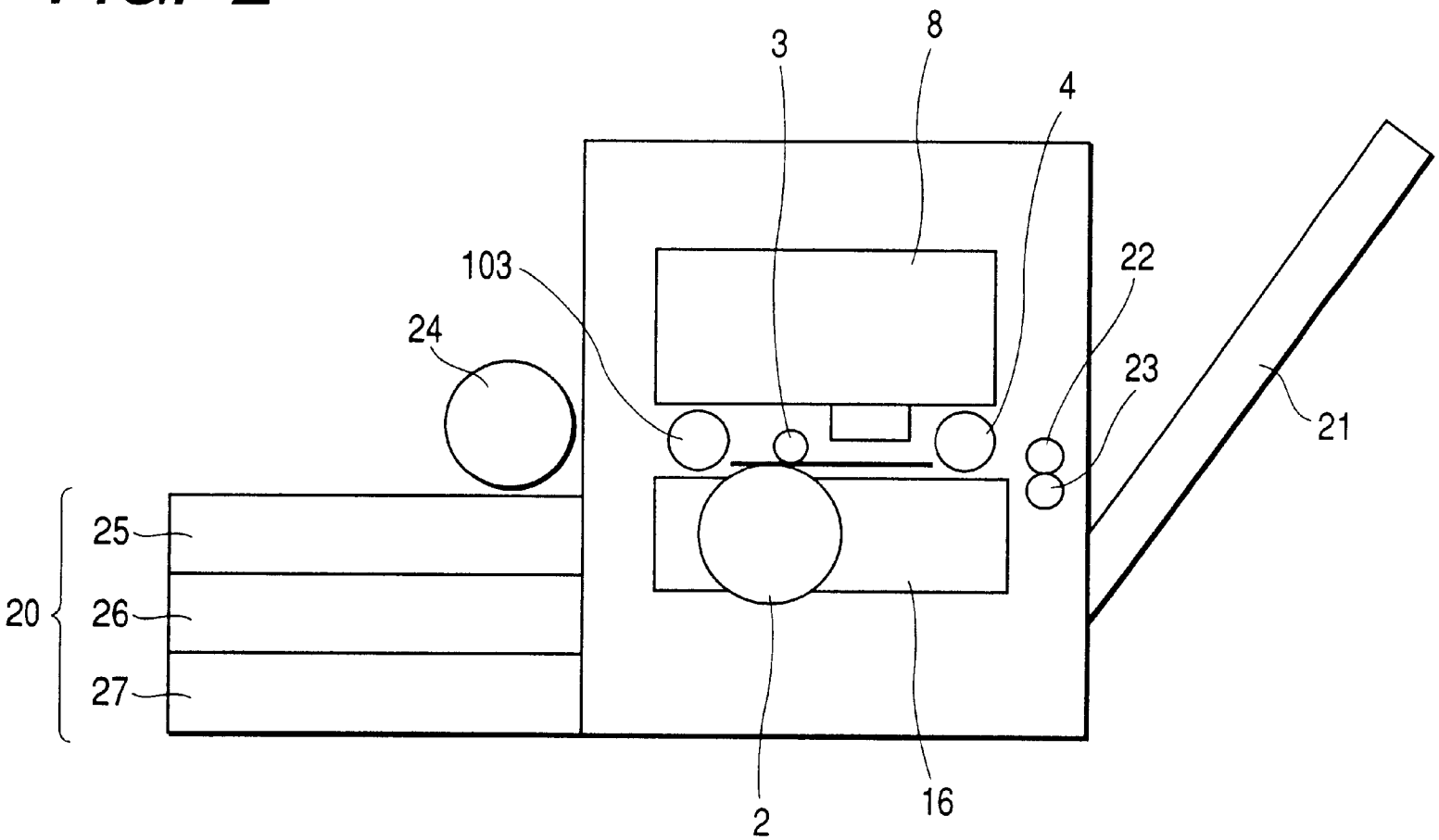
FIG. 2 is a schematic cross-sectional view of a recording apparatus of the first embodiment.

FIG. 2 is a schematic cross-sectional view of the recording apparatus. As shown in FIG. 2, the recording medium is pinched and conveyed by a conveying roller 2 and a pinch roller 3 driven by an LP motor, whereby the recording medium is conveyed onto a platen 16.

The recording portion of the recording head 8 mounted on the carriage 6 protrudes downwards from the carriage 6, whereby a face of the recording head 8 bearing a discharge port is opposed to and is parallel to the recording medium on the platen 16, thereby executing printing.

When the printing operation is completed, the recording medium is conveyed by the conveying roller 2, a discharge roller 23, a spur roller 22 and stacked on a discharge portion 21 in the recording apparatus.

A media cartridge 20 is integrally composed of a sheet cassette portion 25, an ink tank 26 and a waste ink tank 27, and the sheet cassette portion 25 contains recording media in stacked state.

The ink tank 26 contains inks, matching the characteristics of the recording medium, selected from various inks such as processing liquid S to be used for forming the recorded image, black ink B, yellow ink Y, magenta ink M, cyan ink C etc. In the present embodiment there are integrally provided 26Y, 26M and 26C.

The waste ink tank 27 is used for collecting the ink and the processing liquid, not use in recording and discharged from the aforementioned pump unit.

In a state where the media cartridge 20 is mounted in the recording apparatus, the recording medium in the media cartridge is conveyed into the recording apparatus by the rotation of a sheet feeding roller 24.

Figure 3:
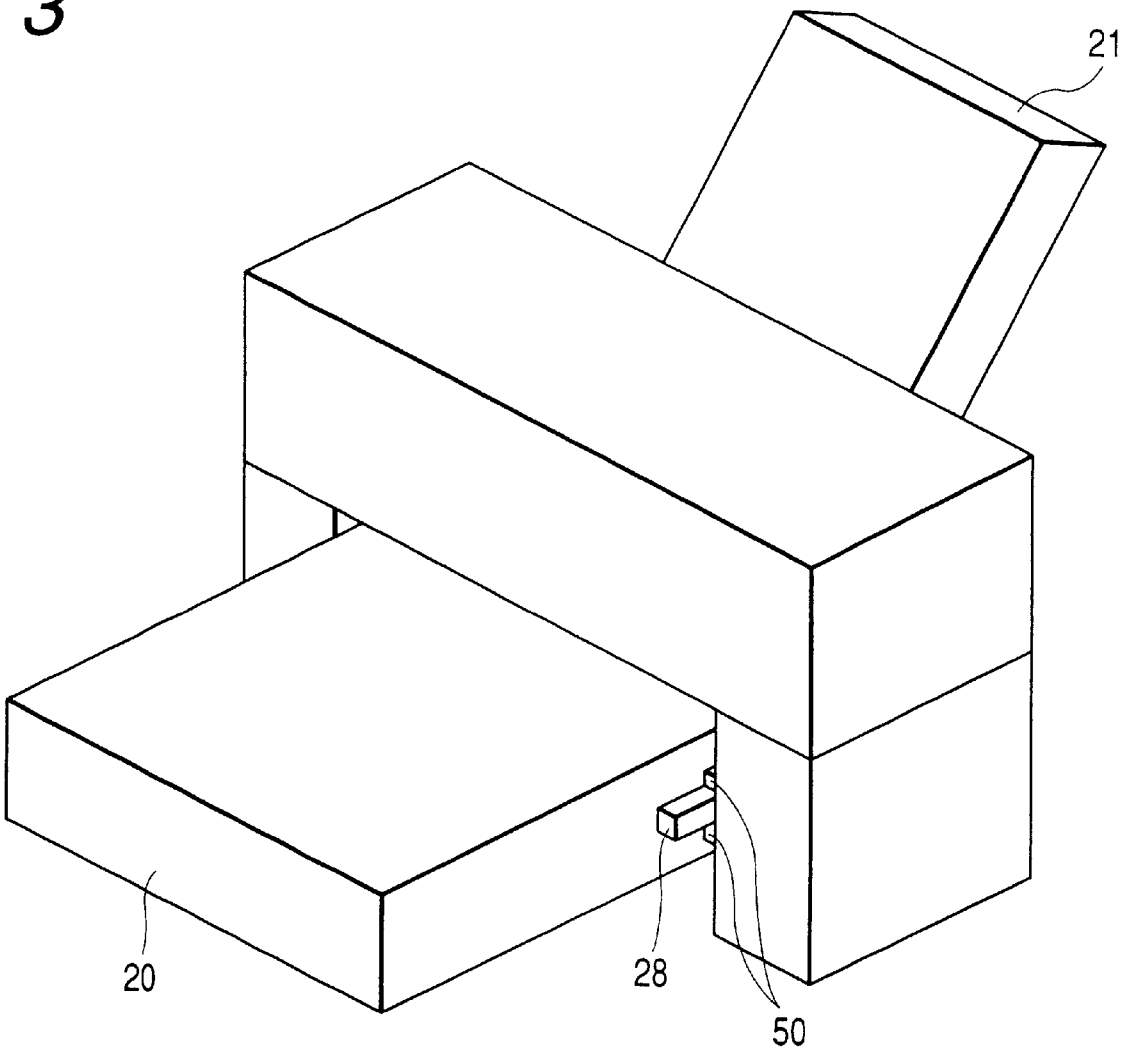
FIG. 3 is a schematic perspective view showing the external view of the recording apparatus of the first embodiment.

FIG. 3 is a schematic perspective view showing the external view of the recording apparatus. As shown in FIG. 3, the cartridge 20 is detachably mounted in the recording apparatus, and is positioned therein by fitting guide ribs 28 of the cartridge 20 in guide grooves 50 of the recording apparatus and inserting the cartridge 20 to an impinging (abutment) portion 29 (cf. FIG. 4).

Figure 4:
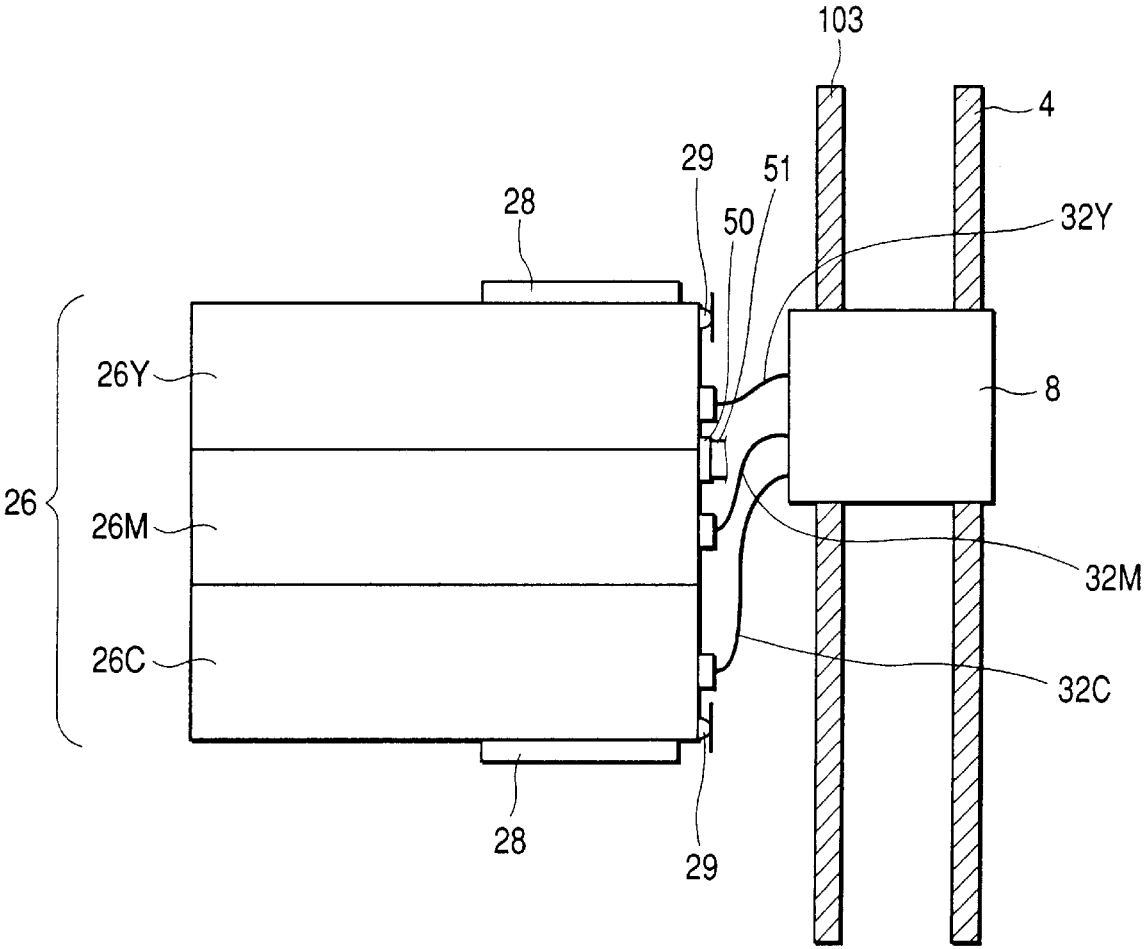
FIG. 4 is a schematic plan view showing the configuration of a cartridge and a recording portion of the first embodiment.
Figure 5:
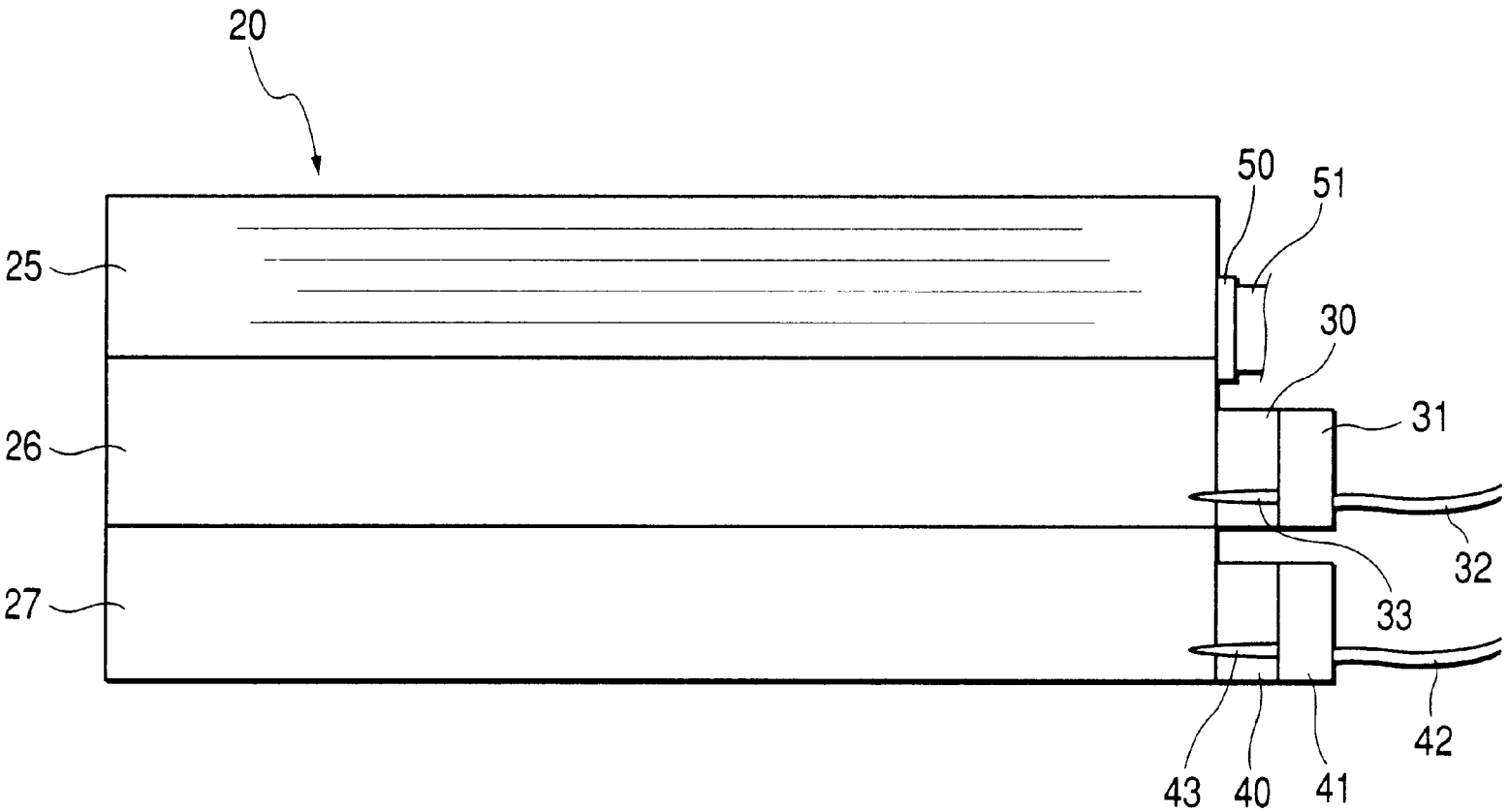
FIG. 5 is a schematic cross-sectional view of the cartridge of the first embodiment.

FIG. 4 is a schematic plan view showing the configuration of the ink tanks 26 of the cartridge and the recording portion, and FIG. 5 is a schematic lateral cross-sectional view of the cartridge.

As shown in FIGS. 4 and 5, ink supply apertures 30 are provided in a part of the ink tanks 26 (26Y, 26M, 26C), and are coupled with ink receiving aperture 31 of the recording apparatus for supplying ink to the recording head 8 through supply tubes 32 (32Y, 32M, 32C). In the ink supply apertures 30 there are inserted sealing members, for example of silicon, for preventing ink leakage from the ink tanks.

Inside the ink receiving aperture 31, there is provided a needle-shaped ink receiving pipe 33 for ensuring the sealing at the coupled state.

On a part of the external surface of the media cartridge 20 there is provided a media cartridge recognition apparatus (information medium) 50, and, upon mounting of the media cartridge 20 on the recording apparatus, the media cartridge recognition apparatus 50 is connected to a detection device 51 of the recording apparatus whereby the information relating to the recording medium and the ink, for example the kind or the amount thereof, is recognized by the recording apparatus (The remaining amounts of the recording medium and the ink are rewritable. Therefore, in case the media cartridge is replaced in the course of service life thereof, the state of the cartridge at the replacement is recorded therein, and, when the cartridge is mounted again on the recording apparatus, the remaining amounts of the recording medium and the ink can be exactly transmitted to the recording apparatus to enable optimum recording operation). Recognizing the kind of the recording medium and ink, the recording apparatus can set a printing mode matching such recording medium and ink.

In consideration of a case where the information cannot be correctly read from the media cartridge for example by a failure in the recognition device 50 or for any other reason, the recording apparatus is preferably so set as to execute the recording operation of highest image quality in such situation, thus giving priority to the quality of the recorded image. For example, it is possible to select a larger number of recording passes in order to attain a higher definition in the color recording, and not to proceed to a next recording pass (not to convey the recording sheet) until the image is fixed, in anticipation for a larger dot placement amount of the ink on the recording medium.

In the present embodiment, for a plain paper cartridge employing plain paper as the recording medium, there are selected yellow, magenta and cyan inks.

However, for example for a coated paper cartridge, a glossy paper cartridge or an OHP sheet cartridge, there may be employed a combination of inks selected suitably from the processing liquid, black ink, yellow ink, magenta ink and cyan ink.

Also for a photographic image quality mode, there may be selected an ink combination consisting of dense black ink, pale black ink, dense yellow ink, pale yellow ink, dense magenta ink, pale magenta ink, dense cyan ink and pale cyan ink.

The optimum recording can be realized by selecting the inks to be adopted in an appropriate combination according to the recording medium.

Also at the coupling portion of the use ink tank 27, a waste ink supply pipe 43 of the waste ink supply aperture 41 is inserted into a sealing member at a waste ink receiving aperture 40 as shown in FIG. 5, whereby the waste inks is collected through a waste ink tube 42 and in the waste ink tank 27.

In the present embodiment, the cassette containing the recording media, the ink tank and the waste ink tank are accommodated in a same cassette, but the cassette may be so constructed as to contain any combination of these components.

For example, the cartridge may be so constructed as to contain the cassette, the ink tank and the information medium, or the recording media, the waste ink tank and the information medium.

[Second Embodiment]

Figure 6:
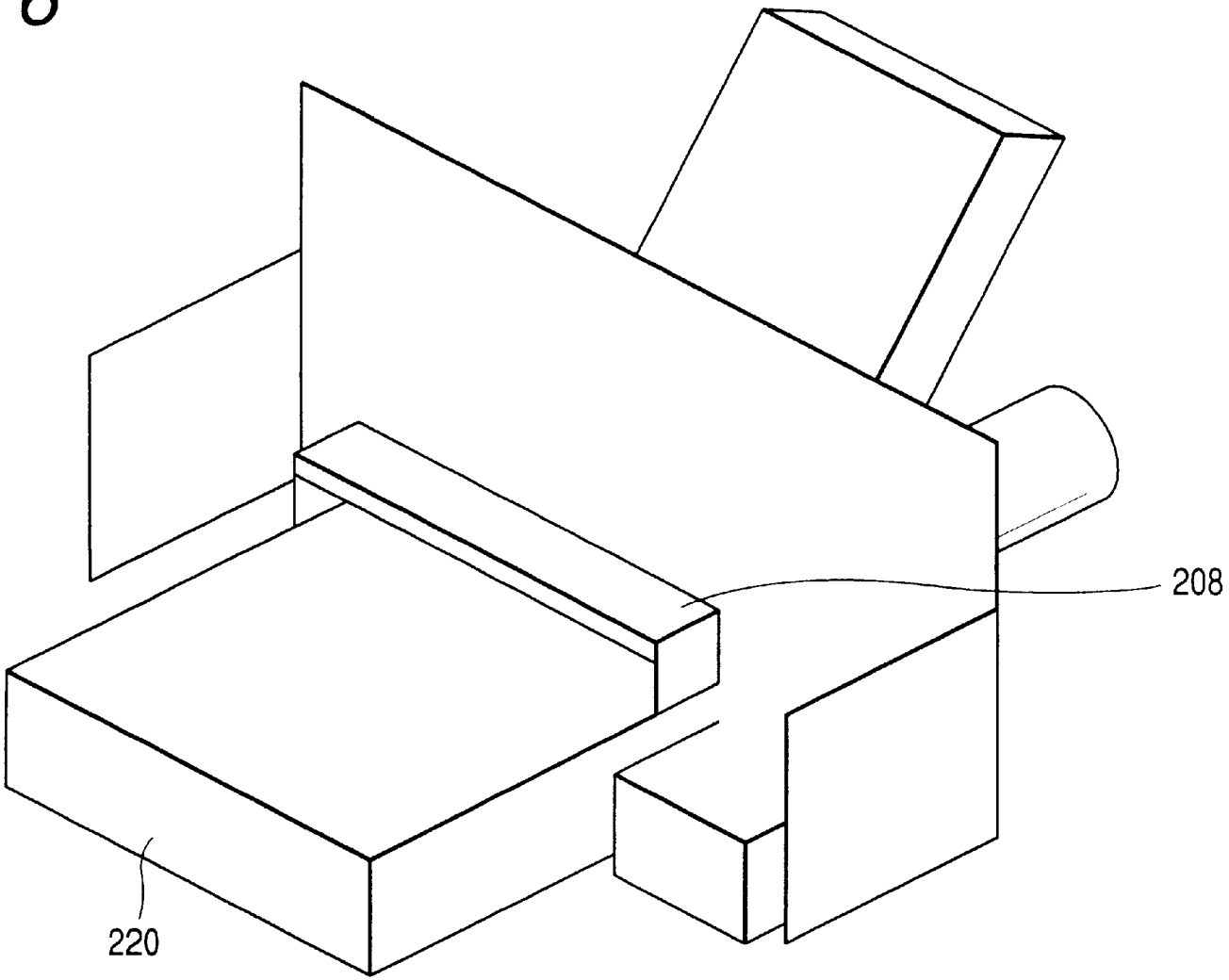
FIG. 6 is a schematic perspective view showing the configuration of the recording portion of a second embodiment.

FIG. 6 shows an ink jet recording apparatus constituting a second embodiment of the present invention.

The foregoing first embodiment provides a serial recording apparatus in which the recording head executes a scanning motion. In case the recording head executes such scanning motion, the integration of the recording head with the media cartridge complicates the driving system for causing the scanning motion of the recording head, leading to an increase size of the recording apparatus.

On the other hand, in case of a recording head having a number of nozzles necessary and enough for covering the width of the recording sheet as shown in FIG. 6, the driving system is not complicated so that the recording head can be relatively easily integrated in the media cartridge by providing the same with an electrical connector for head driving.

Thus there is shown a media cartridge 220 including the recording head, in addition to the sheet cassette, ink tank and waste ink tank.

On the upper face of the recording head 208, a connector is provided for receiving the drive signals for the recording head 208, and is electrically connected to a connector in the recording apparatus when the media cartridge 220 is mounted therein.

The recording head 208 in the present embodiment has a number of nozzles necessary and sufficient with respect to the width of the recording medium, whereby the driving for the recording head 208 can be simplified and the carriage in the first embodiment can be dispensed with.

In the present embodiment, the recording head is incorporated in the same cassette, in addition to the sheet cassette, the ink tank and the waste ink tank, but it is also possible to integrate a disposable cassette containing the above-mentioned recording head and the above-mentioned ink tank, in a same cassette containing the cassette for the recording media and the waste ink tank.

As explained in the foregoing, in the ink jet recording apparatus of the present invention, a media cartridge containing, within a same cassette, a combination of the information medium and any of the cassette for stacking the recording media, the ink tank and the waste ink tank is detachably mountable to the recording apparatus and the recording apparatus can automatically set a printing mode matching the recording medium and the ink by recognizing each cartridge, whereby the printing control can be selected by a simple operation and high reliability can be ensured for the recorded image.

What is claimed is:

1. A media cartridge for holding recording media, said media cartridge being detachably attachable to an ink jet recording apparatus having plural recording modes, a carriage adapted to mount and scan an ink jet head which prints by discharging ink onto a recording medium from said media cartridge, and a conveying mechanism for conveying said recording medium, said media cartridge comprising, in a same container:

a stacked plurality of said recording media;

an ink tank for containing ink to be supplied to said ink jet head;

a waste ink tank for collecting ink not discharged onto said recording medium by said ink jet head; and a storage medium for storing information readable by said ink jet recording apparatus, the information concerning type of recording media and type of ink in said media cartridge, and the information being usable by said ink jet recording apparatus to set one of the plural recording modes.

2. A media cartridge according to claim 1, wherein said storage medium is rewritable with respect to a remaining amount of the ink in said ink tank.

3. A media cartridge according to claim 1, wherein an amount of the ink contained in said ink tank is necessary and sufficient for a number of the stacked plurality of recording media.

4. A recording apparatus comprising:

a mounting portion for mounting a media cartridge according to claim 1;

a conveying mechanism for conveying said recording medium from said media cartridge;

an ink supply mechanism adapted to be connected with the ink tank of said media cartridge and to supply the ink jet head with ink; and a waste ink collecting mechanism for guiding the ink not discharged onto the recording medium by said ink jet head, to said waste ink tank.

5. A recording apparatus according to claim 4, further comprising reading means provided in said mounting portion for reading the information from the storage medium and adapted to transmit the information to the recording apparatus.

6. An ink jet recording apparatus adapted to mount a media cartridge according to claim 1, the ink jet recording apparatus comprising:

a reading means for reading the information from the storage medium of said media cartridge; and a control means for setting a printing mode on the basis of information read by said reading means, wherein said control means sets a high quality printing mode in a case where information concerning a recording medium or an ink type cannot be read by said reading means.

7. An ink jet recording apparatus according to claim 6, wherein said high quality printing mode is a setting for increasing a number of recording passes of recording head to be scanned.

8. An ink jet recording apparatus according to claim 6, wherein said high quality printing mode is a setting for setting an increasing fixing time in anticipation for a large amount of ink dot placement and for not proceeding to a next recording pass until the fixing time is completed.

* * * * *

UNITED STATES PATENT AND TRADEMARK OFFICE

CERTIFICATE OF CORRECTION

PATENT NO. : 6,378,997 B1
DATED : April 30, 2002
INVENTOR(S) : Tetsuhiro Nitta

It is certified that error appears in the above-identified patent and that said Letters Patent is hereby corrected as shown below:

Title page,
Item [56], References Cited, FOREIGN PATENT DOCUMENTS,
"JP 59190857 * 10/1984" should be deleted.

Column 2,
Line 17, "maintained" should read -- maintained at a --.

Column 4,
Line 40, "liquid, not use" should read -- liquid not used --.

Column 5,
Line 49, "use" should read -- used --.

Signed and Sealed this

Eighth Day of October, 2002

*Attest:*

*Attesting Officer*

JAMES E. ROGAN
*Director of the United States Patent and Trademark Office*